US011401752B2

(12) United States Patent
Ang et al.

(10) Patent No.: US 11,401,752 B2
(45) Date of Patent: Aug. 2, 2022

(54) RUGGEDIZED CENTRALIZER FOR SONDE-BASED MEASUREMENT WHILE DRILLING AND LOGGING WHILE DRILLING TOOLS

(71) Applicant: Halliburton Energy Services, Inc., Houston, TX (US)

(72) Inventors: Jun Wei Sean Ang, Singapore (SG); Hun Vee Cheah, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/040,147

(22) PCT Filed: May 30, 2018

(86) PCT No.: PCT/US2018/035154
§ 371 (c)(1),
(2) Date: Sep. 22, 2020

(87) PCT Pub. No.: WO2019/231440
PCT Pub. Date: Dec. 5, 2019

(65) Prior Publication Data

US 2021/0017819 A1 Jan. 21, 2021

(51) Int. Cl.
*E21B 17/10* (2006.01)
*E21B 17/16* (2006.01)

(52) U.S. Cl.
CPC ..... *E21B 17/1078* (2013.01); *E21B 17/16* (2013.01)

(58) Field of Classification Search
CPC ... E21B 17/1085; E21B 17/10; E21B 17/1078
See application file for complete search history.

(56) References Cited

U.S. PATENT DOCUMENTS 5,566,754 A 10/1996 Stokka
5,692,562 A * 12/1997 Squires ..... E21B 17/1064 166/241.3
6,585,043 B1 * 7/2003 Murray ..... E21B 17/1057 166/241.3

(Continued)

FOREIGN PATENT DOCUMENTS

WO 2013082376 A1 6/2013
WO 2014085894 A1 6/2014
WO 2016043901 A1 3/2016

OTHER PUBLICATIONS

PCT Application No. PCT/US2018/035154, International Search Report dated Feb. 27, 2019, 3 pages.

(Continued)

*Primary Examiner* — Shane Bomar
(74) *Attorney, Agent, or Firm* — DeLizio, Peacock, Lewin & Guerra

(57) ABSTRACT

A centralizer includes a centralizer body having a through-bore for receiving a tool. The centralizer includes a centralizer fin radially extending from the centralizer body and longitudinally extending along the centralizer body. The centralizer fin includes a diverter portion. The diverter portion has a front surface at one longitudinal end of the centralizer fin. The centralizer fin includes an engagement portion coupled to the diverter portion distal to the centralizer body. The centralizer fin includes a cladding applied to the front surface of the diverter portion.

20 Claims, 3 Drawing Sheets

(56) References Cited

U.S. PATENT DOCUMENTS

| | | | | |
|---|---|---|---|---|
| 9,562,401 | B1 * | 2/2017 | Smith | E21B 15/00 |
| 9,765,577 | B2 * | 9/2017 | Dicke | E21B 43/10 |
| 10,982,492 | B1 * | 4/2021 | Gopalan | E21B 17/07 |
| 11,261,673 | B2 * | 3/2022 | Martin | E21B 43/127 |
| 2002/0096368 | A1 * | 7/2002 | Kirk | E21B 17/1064 175/385 |
| 2004/0178797 | A1 | 9/2004 | Rioufol et al. | |
| 2005/0150654 | A1 | 7/2005 | Kirk et al. | |
| 2011/0214873 | A1 * | 9/2011 | Krieg | E21B 37/00 166/311 |
| 2014/0151026 | A1 | 6/2014 | Andrigo | |
| 2015/0132539 | A1 * | 5/2015 | Bailey | C23C 16/0254 428/141 |
| 2015/0247388 | A1 * | 9/2015 | Di Crescenzo | E21B 43/108 166/382 |
| 2016/0290068 | A1 | 10/2016 | Riley et al. | |
| 2017/0268299 | A1 * | 9/2017 | Perrin | E21B 17/1078 |
| 2018/0038222 | A1 * | 2/2018 | Samson | E21B 43/20 |
| 2018/0209222 | A1 * | 7/2018 | Greci | E21B 17/18 |
| 2018/0229467 | A1 * | 8/2018 | Walker | B32B 7/08 |
| 2018/0274297 | A1 * | 9/2018 | Pearson | E21B 17/1078 |
| 2019/0040694 | A1 * | 2/2019 | Smith | E21B 17/1078 |
| 2019/0338602 | A1 * | 11/2019 | Budler | E21B 17/1042 |
| 2021/0025248 | A1 * | 1/2021 | Krieger | E21B 17/10 |
| 2021/0348453 | A1 * | 11/2021 | Martin | E21B 17/1071 |

OTHER PUBLICATIONS

PCT Application No. PCT/US2018/035154, Written Opinion dated Feb. 27, 2019, 9 pages.

* cited by examiner

RUGGEDIZED CENTRALIZER FOR SONDE-BASED MEASUREMENT WHILE DRILLING AND LOGGING WHILE DRILLING TOOLS

BACKGROUND

Measurement while drilling (MWD) and logging while drilling (LWD) tools, collectively referred to as MLWD tools, include advanced sensors and electronics to perform detailed and accurate downhole measurements and identification, such as imaging. Insert-based downhole tool arrangements insert the MWD or LWD tool in the tool string such that drilling fluids flow through the center of the tool. In a sonde-based design, the drilling fluids flow around the tool rather than through it. Typically, a centralizer holds the tool, which is typically housed in a sonde, in the center of a MLWD collar. In a sonde-based design, the centralizer is exposed to the flow of drilling fluids and perhaps cuttings and other debris from a well which can affect the functionality of the centralizer and the accuracy of the tool. Designing and building a centralizer to maintain functionality in such an environment is a challenge.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Figure 1:
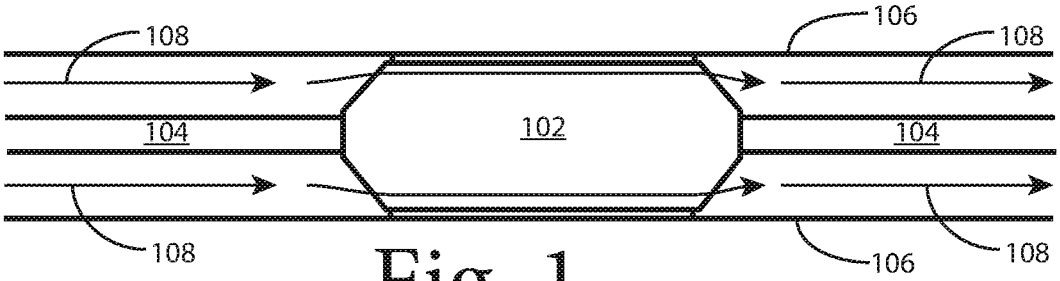
FIG. 1 shows a centralizer in use.

FIG. 1 shows a centralizer in use. A centralizer 102 may hold a tool (or sonde) 104 within an MWLD collar 106. Fluids (indicated by the arrows 108) flowing through the MWLD collar 106 may be diverted around the centralizer 102. The centralizer 102 may be designed to encourage the fluids 108 to flow around the centralizer 102.

Figure 2:
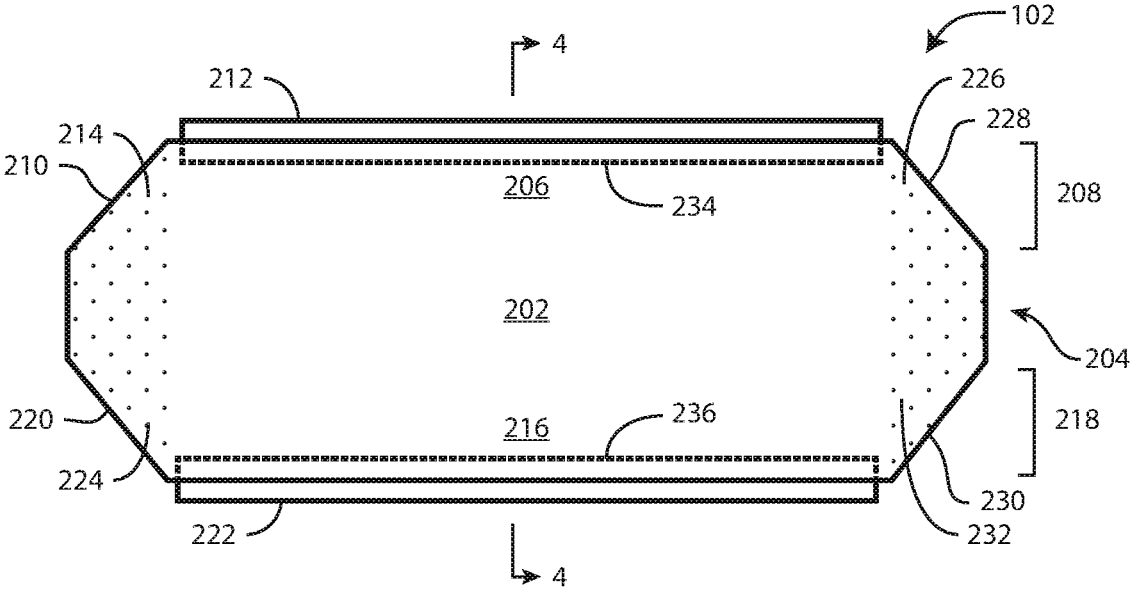
FIG. 2 is a plan view of a centralizer.

FIG. 2 is a plan view of a centralizer. The centralizer 102 may include a centralizer body 202 having a through-bore 204 for receiving the tool 104 (shown in FIG. 1). A centralizer fin 206 may extend radially from the centralizer body 202 and longitudinally along the centralizer body 202. The centralizer fin 206 may include a diverter portion 208 coupled to the centralizer body 202. The diverter portion 208 may have a front surface 210 at one longitudinal end of the centralizer fin 206. The centralizer fin 206 may include an engagement portion 212 coupled to the diverter portion 208 distal to the centralizer body 202. The centralizer fin 206 may be "ruggedized" by including a cladding (represented by the stippling 214) applied to the front surface 210 of the diverter portion 208. The cladding 214, and the other claddings described below, may resist erosion caused by the fluids 108 passing over the centralizer 202.

The centralizer 102 may include a second centralizer fin 216 that may extend radially from the centralizer body 202 and longitudinally along the centralizer body 202. The second centralizer fin 216 may include a second centralizer fin diverter portion 218 coupled to the centralizer body 202. The second centralizer fin diverter portion 218 may have a second centralizer fin front surface 220 at one longitudinal end of the second centralizer fin 216. The second centralizer fin 216 may include a second centralizer fin engagement portion 222 coupled to the diverter portion 218 distal to the centralizer body 202. The second centralizer fin 216 may be ruggedized by including a cladding (represented by the stippling 224) applied to the front surface 220 of the second centralizer fin diverter portion 218.

The centralizer fin 206 may include a rear surface 226 that may include a cladding (represented by stippling 228). The second centralizer fin 216 may include a second centralizer rear surface 230 that may include a cladding (represented by stippling 232).

The diverter portion 208 of the centralizer fin 206 may include a cavity 234 for receiving the engagement portion 212. The diverter portion 218 of the second centralizer fin 216 may include a second centralizer fin cavity 236 for receiving the second centralizer fin engagement portion 222. The centralizer 202 may be designed to maximize the diverter portion 208, 218 of the centralizer fin 206, 216 and minimize the engagement portion 212, 222.

The centralizer 202 may include more than two centralizer fins similar to centralizer fin 206 and second centralizer fin 216 radially extending from the centralizer body. The centralizer fins may be evenly spaced around the circumference of the centralizer body with gaps between the centralizer fins. The number and dimensions of the centralizer fins is designed to permit free flow of the fluids 108 flowing through the MWLD collar 106 (see FIG. 1).

Figure 3:
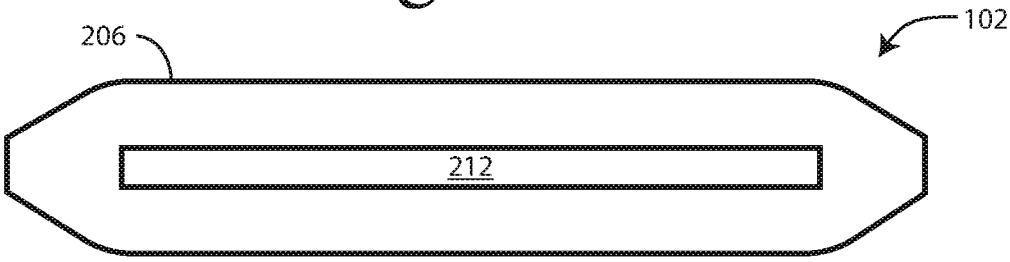
FIG. 3 is a top view of the centralizer of FIG. 2.

FIG. 3 is a top view of the centralizer of FIG. 2. As can be seen, the centralizer fin 206 is tapered on either end.

Figure 4:
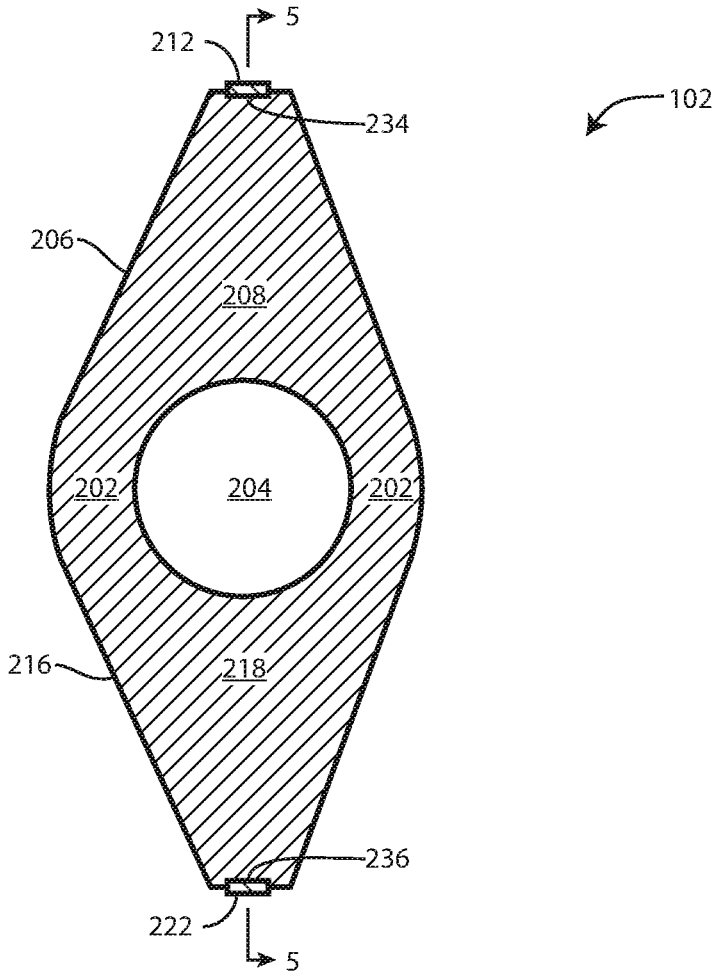
FIG. 4 is a cross-sectional view of the centralizer of FIG. 2 along sight line 4.

FIG. 4 is a cross-sectional view of the centralizer of FIG. 2 along sight line 4. The diverter portion 208 of the centralizer fin 206 may have the shape of a truncated wedge as shown in FIG. 4. Similarly, the diverter portion 218 of the second centralizer fin 216 may have the shape of a truncated wedge. The centralizer body 202, the diverter portion 208 of the centralizer fin 206 and the diverter portion 218 of the second centralizer fin 216 may be a single part with the through-bore 204 bored out or the centralizer body 202 and the two diverter portions 208, 218 may be separately manufactured and coupled together, e.g., by welding or some other suitable process.

Figure 5:
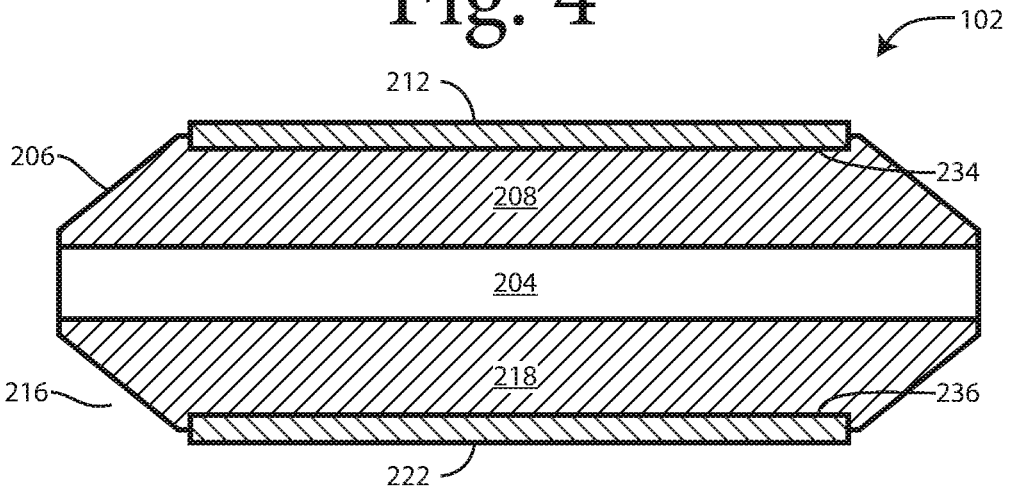
FIG. 5 is a cross-sectional view of the centralizer of FIG. 4 along sight line 5.

FIG. 5 is a cross-sectional view of the centralizer of FIG. 4 along sight line 5. As can be seen, the centralizer 102 tapers at either end.

Figure 6:
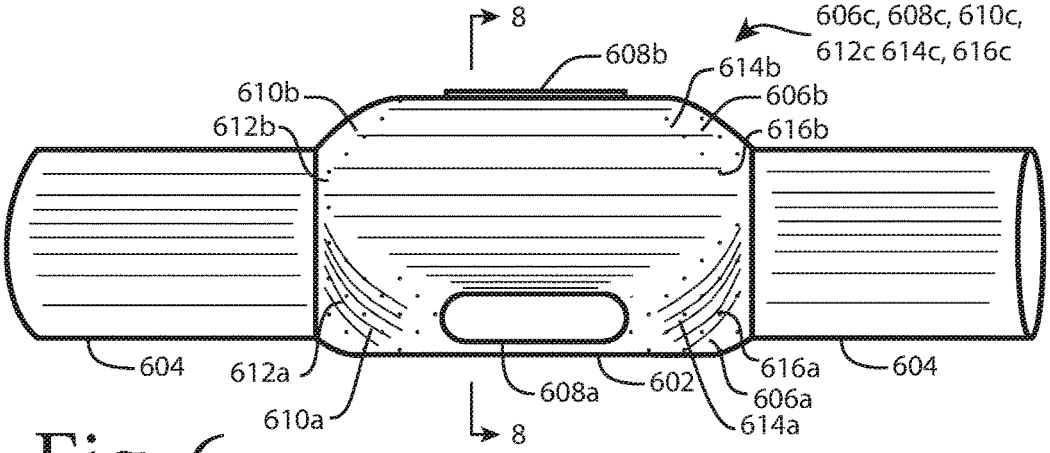
FIG. 6 is a plan view of a centralizer and a sonde.

FIG. 6 is a plan view of a centralizer and a sonde. In another embodiment of a centralizer 602 and a sonde 604 that could be substituted for the centralizer 102 and tool 104 in FIG. 1, the centralizer 602 may include multiple rounded lobes 606*a*, 606*b*, 606*c*, each of which may include a respective engagement portion 608*a*, 608*b*, 608*c* and ruggedizing cladding 610*a*, 610*b*, 610*c* (represented by stippling) on a respective front surface 612*a*, 612*b*, 612*c* of the rounded lobes 606*a*, 606*b*, 606*c*, and optional ruggedizing cladding 614*a*, 614*b*, 614*c* (represented by stippling) on a respective rear surface 616*a*, 616*b*, 616*c* of the lobes 606*a*, 606*b*, 606*c* (lobe 606*c*, engagement portion 608*c*, cladding 610*c*, front surface 612, cladding 614*c*, and rear surface 616*c* are not visible in FIG. 6 but are indicated therein; lobe 606*c* and engagement portion 608*c* can be seen in FIG. 8, discussed below). The centralizer 602 may be designed to maximize the lobes 606*a*, 606*b*, 606*c* of the centralizer 602 and minimize the engagement portions 608*a*, 606*b*, 606*c*.

Figure 7:
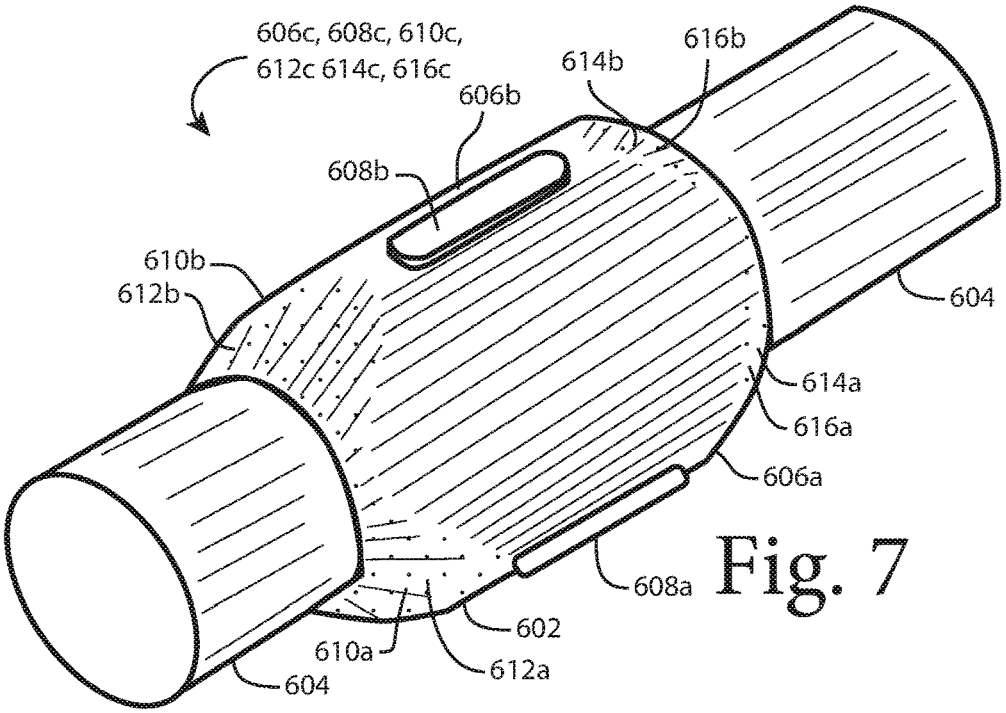
FIG. 7 is a perspective view of the centralizer and sonde of FIG. 6.

FIG. 7 is a perspective view of the centralizer and sonde of FIG. 6. As can be seen, the ruggedizing cladding 610*a*, 610*b*, 610*c* may be applied to the slanted front surfaces 612*a*, 612*b*, 612*c* of the lobes 606*a*, 606*b*, 606*c*. In addition, the ruggedizing cladding 610*a*, 610*b*, 610*c* may be applied to other forward-facing surfaces of the centralizer 602. The ruggedizing cladding 614*a*, 614*b*, 614*c* optionally may be applied to the slanted rear surfaces 616*a*, 616*b*, 616*c* of the lobes 606*a*, 606*b*, 606*c*. In addition, the ruggedizing cladding 614*a*, 614*b*, 614*c* optionally may be applied to other rearward-facing surfaces of the centralizer 602.

Figure 8:
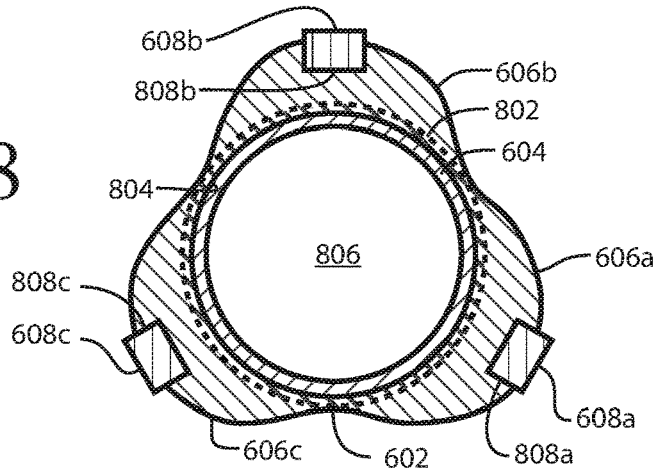
FIG. 8 is a cross-sectional view of the centralizer and sonde of FIG. 6 along sight line 8.

FIG. 8 is a cross-sectional view of the centralizer and sonde of FIG. 6 along sight line 8. As can be seen, the example centralizer 602 shown in FIGS. 6-8 includes three rounded lobes 606*a*, 606*b*, 606*c* that each may have the shape of a portion of a circle in cross-section. It will be understood that the centralizer can include two or more lobes. It will also be understood that the lobes may be distributed evenly around the circumference of the centralizer 602, as shown in FIG. 8.

The centralizer 602 may include a centralizer body 802, indicated by the dashed circle in FIG. 8, adjacent to an inner surface 804 of the centralizer 602 and, when it is installed, the sonde 604.

The centralizer body 802 and the lobes 606*a*, 606*b*, 606*c* may be a single part with a through-bore 806 bored out or the centralizer body 802 and the lobes 606*a*, 606*b*, 606*c* may be separately manufactured and coupled together, e.g., by welding or some other suitable process.

The lobes 606*a*, 606*b*, 606*c* of the centralizer 602 may include respective cavities 808*a*, 808*b*, 808*c* for receiving respective engagement portions 608*a*, 608*b*, 608*c*.

The centralizer body 202, 802, diverter portion 208, the second centralizer diverter portion 218, and the lobes 606*a*, 606*b*, 606*c* may be made from an austenitic stainless steel, cobalt based alloy, a nickel-based alloy, or an advanced ceramic material. The centralizer body 202 may be integral with and made from the same material as the diverter portion 208 and/or the second centralizer diverter portion 218. The centralizer body 802 may be integral with and made from the same material as the lobes 606*a*, 606*b*, 606*c*. The centralizer body 202, 802 may be made from a non-magnetic material having good wear resistance.

The ruggedizing cladding 214, 224, 226, 232, 610*a*, 610*b*, 610*c*, 614*a*, 614*b*, and/or 614*c* may be a hardfacing designed to take the brunt of the erosive force from the fluids 108 flowing through the MWLD collar 106. The hardfacing material may be a spherical fused tungsten carbide, an encapsulated diamond in a nickel based matrix, stellite 6, or nickel based tungsten carbide.

The engagement portions 212, 222, 608*a*, 608*b*, 608*c* may be made of elastomer materials suitable for operation in a downhole temperature of at least 150° Centigrade in an environment with water-based and oil-based drilling mud, such as hydrogenated nitrile butadiene rubber (HNBR) or a fluoroelastomer (FKM). The engagement portions 212, 222, 608*a*, 608*b*, 608*c* maintain good contact between the centralizer 102, 602 and the MWLD collar 106 so that the centralizer 102, 602 will perform its centralizing function.

The centralizer of FIGS. 1-5 is designed to optimize fluid flow with the fins 206, 216 by cutting through the flow of fluids 108 like the fin of a shark and diverting the flow of fluids 108 into gaps between the fins. The centralizer of FIGS. 6-8 is designed to optimize fluid flow by cutting through the flow of fluids 108 with each of the lobes 606*a*, 606*b*, 606*c* acting like the bow of a submarine, diverting the flow of fluids into the gaps between the lobes 606*a*, 606*b*, 606*c*.

In one aspect, a centralizer includes a centralizer body having a through-bore for receiving a tool. The centralizer includes a centralizer fin radially extending from the centralizer body and longitudinally extending along the centralizer body. The centralizer fin includes a diverter portion. The diverter portion has a front surface at one longitudinal end of the centralizer fin. The centralizer fin includes an engagement portion coupled to the diverter portion distal to the centralizer body. The centralizer fin includes a cladding applied to the front surface of the diverter portion.

Implementations may include one or more of the following. The centralizer may include a second centralizer fin radially extending from the centralizer body opposite the centralizer fin. The centralizer may include a plurality of centralizer fins radially extending from the centralizer body and spaced around a circumference of the centralizer body. The diverter portion may include an indentation for receiving the engagement portion. The cladding may include one or more of a ceramic thermal spray or a hard metal welded to the front surface of the diverter portion. The diverter portion may have a cross-sectional shape perpendicular to the longitudinal extent of the centralizer fin of a truncated wedge or of a rounded lobe. The diverter portion may be integral with the centralizer body.

In one aspect, an assembly includes a drill collar and a centralizer. The centralizer includes a centralizer body having a through-bore for receiving a tool. The centralizer includes a centralizer fin radially extending from the centralizer body and longitudinally extending along the centralizer body. The centralizer fin includes a diverter portion. The diverter portion has a front surface at one longitudinal end of the centralizer fin. The centralizer fin includes an engagement portion coupled to the diverter portion distal to the centralizer body and engaging the drill collar. The centralizer fin includes a cladding applied to the front surface of the diverter portion.

Implementations may include one or more of the following. The centralizer may include a second centralizer fin radially extending from the centralizer body opposite the centralizer fin. The second centralizer fin may engage the drill collar. The centralizer may include a plurality of centralizer fins radially extending from the centralizer body and spaced around a circumference of the centralizer body. The diverter portion may include an indentation for receiving the engagement portion. The cladding may include one or more of a ceramic thermal spray or a hard metal welded to the front surface of the diverter portion. The diverter portion may have a cross-sectional shape perpendicular to the longitudinal extent of the centralizer fin of a truncated wedge or of a rounded lobe.

In one aspect, a centralizer includes a centralizer body including a through-bore for receiving a drilling component. The centralizer includes a plurality of centralizer fins radially extending from the centralizer body and longitudinally extending along the centralizer body. The centralizer includes gaps between the centralizer fins to allow fluid flow along the centralizer body between the centralizer fins. The plurality of centralizer fins is shaped to urge longitudinally-flowing fluids into the gaps. The plurality of centralizer fins have ruggedized surfaces at one of their longitudinal ends.

Implementations may include one or more of the following. At least one of the plurality of centralizer fins may include a diverter portion having a front surface at one longitudinal end, an engagement portion coupled to the diverter portion distal to the centralizer body, and a cladding applied to the front surface of the diverter portion. The cladding may include one or more of a ceramic thermal spray or a hard metal welded to the front surface of the diverter portion. The diverter portion may have a cross-sectional shape perpendicular to the longitudinal extent of the centralizer fin of a truncated wedge or of a rounded lobe. The centralizer fins may be evenly distributed around a circumference of the centralizer body.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A centralizer for use within a downhole tool comprising:

a centralizer body having a through-bore for receiving a tool;

a centralizer fin radially extending from the centralizer body and longitudinally extending along the centralizer body, the centralizer fin including:

a diverter portion having a front surface at one longitudinal end of the centralizer fin;

an engagement portion coupled to the diverter portion distal to the centralizer body, the engagement portion comprising an elastomer material that engages an internal surface of the downhole tool; and a cladding applied to the front surface of the diverter portion.

2. The centralizer of claim 1 further comprising:

a second centralizer fin radially extending from the centralizer body opposite the centralizer fin.

3. The centralizer of claim 1 further comprising:

a plurality of centralizer fins radially extending from the centralizer body and spaced around a circumference of the centralizer body.

4. The centralizer of claim 1 wherein the diverter portion includes an indentation for receiving the engagement portion.

5. The centralizer of claim 1 wherein the cladding includes one or more of a ceramic thermal spray or a hard metal welded to the front surface of the diverter portion.

6. The centralizer of claim 1 wherein the diverter portion has a cross-sectional shape perpendicular to the longitudinal extent of the centralizer fin of a truncated wedge or of a rounded lobe.

7. The centralizer of claim 1 wherein the diverter portion is integral with the centralizer body.

8. An assembly comprising:

a drill collar;

a centralizer positioned within the drill collar, the centralizer including:

a centralizer body having a through-bore for receiving a tool;

a centralizer fin radially extending from the centralizer body and longitudinally extending along the centralizer body, the centralizer fin including:

a diverter portion having a front surface at one longitudinal end of the centralizer fin, an engagement portion coupled to the diverter portion distal to the centralizer body and engaging an internal surface of the drill collar, and a cladding applied to the front surface of the diverter portion.

9. The assembly of claim 8 wherein the centralizer further comprises:

a second centralizer fin radially extending from the centralizer body opposite the centralizer fin, the second centralizer fin engaging the drill collar.

10. The assembly of claim 8 wherein the centralizer further comprises:

a plurality of centralizer fins radially extending from the centralizer body and spaced around a circumference of the centralizer body.

11. The assembly of claim 8 wherein the diverter portion includes an indentation for receiving the engagement portion.

12. The assembly of claim 8 wherein the cladding includes one or more of a ceramic thermal spray or a hard metal welded to the front surface of the diverter portion.

13. The assembly of claim 8 wherein the diverter portion has a cross-sectional shape perpendicular to the longitudinal extent of the centralizer fin of a truncated wedge or of a rounded lobe.

14. The assembly of claim 8 wherein the diverter portion is integral with the centralizer body.

15. A centralizer for use within a downhole tool comprising:

a centralizer body including a through-bore for receiving a drilling component;

a plurality of centralizer fins radially extending from the centralizer body and longitudinally extending along the centralizer body;

gaps between the centralizer fins to allow fluid flow along the centralizer body between the centralizer fins;

the plurality of centralizer fins being shaped to urge longitudinally-flowing fluids into the gaps; and the plurality of centralizer fins having ruggedized surfaces at one of their longitudinal ends;

wherein at least one of the plurality of centralizer fins includes an engagement portion coupled distal to the centralizer body, the engagement portion comprising an elastomer material that engages an internal surface of the downhole tool.

16. The centralizer of claim 15 wherein at least one of the plurality of centralizer fins includes:

a diverter portion having a front surface at one longitudinal end;

and a cladding applied to the front surface of the diverter portion.

17. The centralizer of claim 16 wherein the cladding includes one or more of a ceramic thermal spray or a hard metal welded to the front surface of the diverter portion.

18. The centralizer of claim 16 wherein the diverter portion has a cross-sectional shape perpendicular to the longitudinal extent of the centralizer fin of a truncated wedge or of a rounded lobe.

19. The centralizer of claim 15 wherein the centralizer fins are evenly distributed around a circumference of the centralizer body.

20. The centralizer of claim 15 wherein the centralizer fins are integral with the centralizer body.

* * * * *